United States Patent [19]

Craig

[11] 4,130,449

[45] Dec. 19, 1978

[54] THICKENED AQUEOUS SLURRY EXPLOSIVE COMPOSITIONS

[75] Inventor: Joseph F. M. Craig, Beloeil, Canada

[73] Assignee: Canadian Industries Limited, Montreal, Canada

[21] Appl. No.: 907,970

[22] Filed: May 22, 1978

[30] Foreign Application Priority Data

Jun. 23, 1977 [CA] Canada ..... 281298

[51] Int. Cl.[2] ..... C06B 31/12

[52] U.S. Cl. ..... 149/62; 149/43; 149/44; 149/92

[58] Field of Search ..... 149/44, 92, 60, 62, 149/61

[56] References Cited

U.S. PATENT DOCUMENTS

| | | | |
|---|---|---|---|
| 3,730,790 | 5/1973 | Falconer et al. | 149/44 |
| 3,748,201 | 7/1973 | Jordan | 149/44 X |

*Primary Examiner*—Stephen J. Lechert, Jr.
*Attorney, Agent, or Firm*—Donald G. Ballantyne

[57] ABSTRACT

A thickened, aqueous slurry explosive composition containing a soluble organic nitrate sensitizer is provided which has improved rheological properties. Use in the composition as a thickener, of a mixture of an unmodified guar gum and a hydroxypropyl-modified guar gum provides a composition which retains flowability for an hour or more for easy extrusion packaging yet achieves a high level of gel strength and cartridge rigidity within a day after packaging.

6 Claims, No Drawings

THICKENED AQUEOUS SLURRY EXPLOSIVE COMPOSITIONS

This invention relates to gelled or thickened aqueous slurry explosive blasting compositions of improved rheological properties. More particularly, the invention relates to thickened slurry explosive compositions containing as a sensitizing ingredient a water soluble organic nitrate, for example, ethyleneglycol mononitrate.

Thickened aqueous explosive slurries containing soluble organic nitrate sensitisers have been disclosed, for example, by Minnick in U.S. Pat. No. 3,409,484 issued Nov. 5, 1968, by Dunglinson et al. in U.S. Pat. No. 3,431,155 issued Mar. 4, 1969, by Fee et al. in U.S. Pat. No. 3,401,067 issued Sept. 10, 1968 and by Fee et al. in U.S. Pat. No. 3,653,992 issued Apr. 4th, 1972. In all of these patents the disclosed compositions contain as an essential ingredient a thickener or gelling agent in order to prevent segregation or precipitation of the ingredients, to provide mixtures which may be more easily worked and packaged in firm, shape-retaining cartridges and to impart properties of water resistance which are required when the explosives are used in wet environments. These thickening or gelling agents generally include materials such as, for example, gum arabic, agar-agar, Irish moss, locust bean, tamarind, psyllum or guar gums, starches, hydroxyethylcellulose and hydrophilic vinyl polymers such as polyacrylamide. The most widely employed of the thickeners which have been used with aqueous slurry explosives has been guar gum which material may be procured in self-complexing forms where a cross-linking agent is incorporated or in non-complexing forms which contain no cross-linking agent. When the non-complexing form is used, usually small amounts of a conventional cross-linking agent, such as borax or potassium pyroantimonate and the like are employed to produce a firmer or stronger gel. Generally the explosives industry has preferred to use the non-complexing form of thickener in order to more easily control the properties of the mixture particularly with regard to the degree of firmness desired. Depending on the desired end use of the aqueous slurry explosive and the method of manufacture employed, its thickness or degree of gelatinization may range from a highly flowable consistency to that of a very firm, rubber-like gel. These properties result in large part from the amount and kind of gelling agent employed. In the preparation of slurry explosives containing soluble organic nitrate sensitizers, particular problems are encountered since the more conventional gelling agents employed in most explosive slurries are generally ineffective or unduly slow in their activity so as to be unsuitable for use. This unsuitability is attributed to the interfering action in solution of the dissolved organic nitrate sensitizer which tends to prevent or retard hydration of the thickener. It has been generally found that in the presence of soluble organic nitrate, the so-called modified guar gums, that is, hydroxyethyl- and hydroxypropyl-modified guars, are most effective as thickeners and are preferred. Indeed, in some compositions these modified guars are the only thickeners which can be usefully employed.

Guar gum is classified in chemical terms as a galactomannan, or a high molecular weight carbohydrate polymer or polysaccharide made up of mannose and galactose units linked together in the manner shown in the structural formula below.

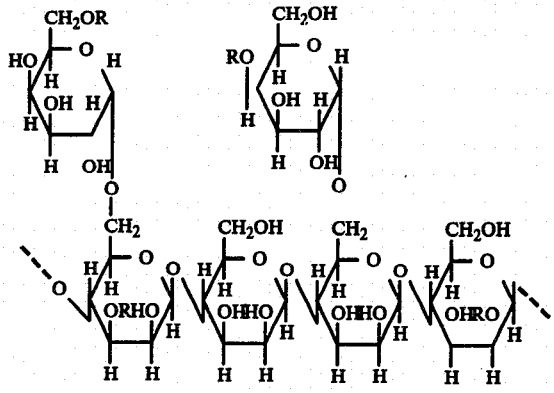

With standard or unmodified guar, R is hydrogen. With hydroxyethyl-modified guar, R is $CH_2CH_2OH$ and the number of moles of the substituent R per galactomannan unit may vary from about 0.7 to about 1.3. With hydroxypropyl-modified guar, R is $CH_2CH(CH_3)OH$ and the number of moles of the substituted R may vary from about 0.35 to about 0.45.

When soluble organic nitrate sensitized aqueous slurries are thickened by means of hydroxyethyl guar or hydroxypropyl guar, it is found that very high viscosities are produced very rapidly. This, in turn, leads to difficulty in processing since the mixed slurry must be packaged relatively quickly after mixing. Any delay can result in a mixture which is too viscous to handle in the conventional packaging machines. When the amount of thickener employed is reduced in order to achieve suitable lower viscosities for easy packaging, the slurry explosive product generally remains unduly soft resulting in a limp cartridge or package which stores poorly and is difficult to handle in blasting operations. The elastic memory of the gel also often results in packages which burst after sealing and the borehole tampability of the cartridge is reduced. What the industry has been seeking in order to overcome the afore-mentioned difficulties is a thickener for use with organic nitrate sensitized aqueous slurry explosives which results in a product which is easily mixed and which retains flowability and pumpability for several hours to permit easy packaging yet which will result in a firm and tampable cartridge or borehole charge. It has now been found that these industry objectives can be achieved by employing as a thickener for organic nitrate sensitized aqueous slurry explosives, a proportioned mixture of hydroxypropyl-modified guar and an unmodified guar.

It has been discovered that the use of a blend of unmodified guar and hydroxypropyl-modified guar produces an unexpected synergistic effect with slurry systems containing organic nitrate sensitizers in that the final gel strength of the compositions after packaging is substantially greater than the gel strength of similar compositions when thickened either by the modified guar or the unmodified guar alone. Further, it has also been found that this synergism is accelerated when calcium nitrate is present as an oxidizing salt ingredient in the explosive mix.

In the manufacture and packaging of aqueous explosive slurry compositions, the explosive industry has adapted as a small diameter cartridge product, a thin-walled plastic film tube sealed or closed at each end and containing the slurry explosive composition. These cartridges are manufactured by means of especially adapted sausage stuffer machines wherein the slurry product is extruded under pressure into the plastic film tube which is thereafter sealed or closed. Since this extrusion process is normally carried out by exerting pressure either through blowcasing or pumping of the explosive compositions, it is necessary to limit the pressure in order to reduce the hazard associated with this manufacturing process and in some cases, to preserve the explosive properties of the compositions. Generally, this process requires working pressures ranging from 20 to 100 psig, the latter being an uppermost limit. This limitation requires that the slurry product be sufficiently non-viscous or flowable during packaging to eliminate any hazard due to excess pressures yet after packaging, the slurry must possess the characteristic of a stiff, firm, putty-like composition so as to retain the cartridge shape and provide an easily handled product which will not lose its configuration during prolonged storage. The use of the blended guars and, optionally, calcium nitrate of the present invention provides an organic nitrate sensitized aqueous slurry which remains fluid and pumpable during the mixing and packaging operations yet achieves a high level of gel strength and cartridge rigidity within a day following cartridging.

In order to process and package explosive slurry compositions through a conventional sausage-stuffer type cartridging machine, at the safe pressures of less than 100 psig (without the application of viscosity-reducing heat which otherwise could further increase the hazards of manufacture), it has been determined that the unaerated, thickened liquid phase of slurry compositions, as in Example 1, should have an 'apparent' viscosity of not more than about 200,000 centipoise. The term 'apparent' viscosity is used in view of the pseudo plastic, non-Newtonian behavior of these gels which results in viscosity measurements that are dependent on the rate of shear expressed in Revolutions Per Minute of the measuring instrument. Expressed in terms of a reading from a Brookfield RVT Viscometer using a No. 6 spindle at 5 RPM, 200,000 centipoise is equivalent to a reading of 100.

Thus it is the objective of the industry to provide a slurry composition whose liquid has an 'apparent' viscosity of not more than 100 (Brookfield) during mixing and packaging cycle (generally about 60 minutes), and thereafter to increase in viscosity to achieve high gel strength and cartridge rigidity. The high gel strengths being sought are equivalent to 'apparent' viscosities of liquid phases in excess of 5,000,000 centipoise. Expressed in terms of a reading from a Brookfield Helipath viscometer (using T bar F at 1 RPM) 5,000,000 centipoise is equivalent to a reading of 50.

The compositions of the present invention comprise one or more inorganic oxygen-supplying salts dissolved in an aqueous phase together with sensitizer, fuel, thickener and cross-linker ingredients. Typical of such oxidizing salts are ammonium, sodium and calcium nitrates and ammonium, sodium and calcium perchlorates or mixtures of these. Generally from about 30% to 75% by weight of the total slurry composition consists of oxidizer salt. Advantageously, up to 27% by weight of the total oxidizer salt may consist of calcium nitrate, the presence of which enhances the thickening behavior of the mixed guars. The essential water ingredient is generally present in an amount of from about 7% to 25% by weight, the actual amount being dependent on the presence of other fluid ingredients. Solid or liquid fuels are desirably present in an amount up to 40% by weight and may comprise liquid fuels such as alcohol or glycol or may comprise solid fuels, for example, particulate carbonaceous materials such as coal, gilsonite, aluminium or other light metal particles and the like. The essential soluble organic nitrate sensitizer which is substantially totally dissolved in the aqueous fluid phase may comprise any of the well known soluble organic nitrate sensitizers. These include, for example, the lower alkylamine nitrates such as methylamine nitrate and ethylamine nitrate, the alkanolamine nitrates such as ethanolamine nitrate and propanolamine nitrate, other nitrogen based salts such as ethylenediamine dinitrate, urea nitrate and aniline nitrate and the hydroxyalkyl nitrates such as ethyleneglycol mononitrate or propylene glycol mononitrate. The latter are particularly preferred because of their ready solubility in aqueous inorganic salt solutions. Generally from 10% to 31% by weight of sensitizer is employed. The essential blended guar thickener is present in an amount of from 0.2% to 2.0% preferably from 0.4% to 1.6% by weight of the total composition. Said thickener mixture comprises from 15% by weight of a modified guar and 85% by weight of an unmodified guar up to 85% by weight of a modified guar and 15% by weight of an unmodified guar. A cross-linker may be present in an amount up to about 1.0% by weight of the total composition.

The following Examples and Table illustrate the unique synergistic properties of the mixed modified and unmodified guars when employed as thickeners in slurry explosive compositions sensitized by means of soluble organic nitrates and further show the particular effect of calcium nitrate in accelerating the synergism.

EXAMPLE 1

Three typical liquid phases of organic nitrate sensitized slurries were prepared using standard slurry mixing procedures according to the formulations below, the quantities shown being percent by weight of total composition.

| | Comp. A | Comp. B | Comp. C |
|---|---|---|---|
| Ethyleneglycol[1] mononitrate | 25.96 | 31.07 | 23.00 |
| Ammonium nitrate | 32.15 | 37.26 | 32.75 |
| Sodium nitrate | 3.15 | 3.74 | 9.00 |
| Calcium nitrate | 15.14 | — | 13.20 |
| Water | 19.57 | 23.40 | 15.00 |
| Ethylene glycol | 2.35 | 2.85 | 3.80 |
| Thickener | 1.60 | 1.60 | 1.50 |
| Surfactants | — | — | 1.00 |
| Potassium pyroantimonate (x-linker) | 0.08 | 0.08 | 0.09 |
| Chalk | — | — | 0.60 |

[1]contains 90% EGMN plus 10% mixed diethyleneglycolmononitrate and diethyleneglycol The above compositions can be converted to complete slurry explosive mixture by adding further solid material, that is, additional oxidizer salt such as ammonium nitrate and/or additional fuel material such as powdered light metals or carbonaceous ingredients and the like.

The above Composition A was prepared with a variety of thickeners used alone or in combinations as shown in Table I below. The 'apparent' viscosities, in terms of Brookfield RVT, No. 6 spindle at 5 RPM viscometer readings are shown during the normal period of mixing and packaging, that is, up to 60 minutes.

TABLE I

| Thickener Composition %/wt. | | A1 | A2 | A3 | A4 | A5 | A6 | A7 | A8 | A9 | A10 |
|---|---|---|---|---|---|---|---|---|---|---|---|
| Hydroxypropyl guar[1]) | | 1.6 | — | 0.8 | 0.8 | 0.8 | 0.8 | 0.8 | — | — | — |
| Unmodified guar | | — | 1.6 | 0.8 | — | — | — | — | — | 0.8 | 0.8 |
| Tapioca starch | | — | — | — | 0.8 | — | — | — | — | — | — |
| Hydroxyethyl guar[2]) | | — | — | — | — | — | — | 0.8 | 1.6 | 0.8 | — |
| Cornstarch | | — | — | — | — | 0.8 | — | — | — | — | — |
| Psyllium flour | | — | — | — | — | — | 0.8 | — | — | — | — |
| Hydroxyethyl guar[3]) | | — | — | — | — | — | — | — | — | — | 0.8 |
| Viscosity (Brookfield) | | | | | | | | | | | |
| Time mins. | 10 | 14 | 1 | 3 | 4 | 1 | 4 | 8 | 3 | 1 | 2 |
| | 20 | 31 | 2 | 10 | 11 | 8 | 9 | 15 | 7 | 3 | 4 |
| | 40 | 60 | 4 | 24 | 23 | 19 | 15 | 29 | 16 | 8 | 10 |
| | 60 | 78 | 8 | 34 | 27 | 21 | 19 | 42 | 29 | 15 | 19 |

[1]) moles substituent per molecule = 0.35 - 0.45
[2]) moles substituent per molecule = 0.9 - 1.3
[3]) moles substituent per molecule = 0.7 - 1.0

An examination of the results given in Table I provides the following information. At the level of thickener employed, 1.6% by weight of the total compositions, composition A1 containing hydroxypropyl guar thickened too rapidly for safe cartridging. Unmodified guar (Composition A2) does not provide any significant thickening. Blends of hydroxypropyl guar with unmodified guar (A3), with tapioca starch (A4), with cornstarch (A5) and with psyllium flour (A6) produce viscosities which are significantly less than those obtained when using hydroxypropyl guar alone. A blend of hydroxypropyl guar and hydroethyl guar (A7) also prouces a lowered viscosity although not as effective as that of composition A3.

EXAMPLE 2

Thickened liquid phases of slurry compositions from Example 1 and containing various thickeners or combinations of thickeners were measured for viscosity (Brookfield T Bar F at 1 RPM) for periods of up to 15 days after mixing and cartridging in order to determine the strength of the finally developed gel. The results are shown in Table II below, the numbers representing Brookfield viscometer readings.

TABLE II

| | Composition A - containing 1.6% hydroxypropyl guar[1]) | containing unmodified guar 1.6% | containing 0.8% hydroxypropyl guar + 0.8% unmodified guar | containing 0.8% hydroxypropyl guar + 0.8% hydroxyethyl guar | containing 0.8 hydroxypropyl guar + 0.8% tapioca |
|---|---|---|---|---|---|
| Days after mixing: | | | | | |
| 1 | 52 | * | 27 | 49 | 33 |
| 4 | 59 | * | 73 | 55 | 35 |
| 8–11 | 63 | * | 79 | 65 | 40 |
| 15 | * | 80 | 63 | 38 | |
| Days | Composition B - [2]) | | | | |
| Days after mixing: | | | | | |
| 1 | — | * | — | 38 | 19 |
| 4 | 31 | * | 52 | 38 | 23 |
| 8–11 | 33 | * | 62 | 45 | 24 |
| 15 | 34 | * | 65 | 48 | 30 |

[1]) Contains 15.14% calcium nitrate
[2]) Devoid of calcium nitrate
* Gel breakdown - no reliable measurement obtained An examination of the results given in Table II provides the following information. At the level of thickener employed, 1.6% by weight of the total composition, the use of hydroxypropyl guar with both Composition A and Composition B produced a gel of good strength but which, as shown in Table I, becomes viscous too quickly for safe processing. Both Composition A and Composition B with hydroxypropyl guar/unmodified guar, with hydroxypropyl guar/hydroxyethyl guar, and with hydroxypropyl guar/tapioca gave adequate strength long term and, from the results in Table I, are shown to possess reduced process viscosities. The preferred blend of hydroxypropyl guar and unmodified guar provide a gel of superior strength yet which was sufficiently flowable during initial processing (Table I) to be safe. It can be further noted that first gel strength is substantially increased in Composition A which contains calcium nitrate. The presence of calcium nitrate therefore, has a beneficial effect in developing enhanced gel strength with modified guars used both singly and in combinations.

EXAMPLE 3

From the data shown in Tables I and II it will be evident that once the explosives maker has determined the limits of the viscosity under which his particular cartridging machine can safely operate, he may then alter the ratio of hydroxypropyl guar/unmodified guar for optimum processing viscosity and final gel strength. A series of thickened slurry liquid phases were made from Composition C and containing various amounts and ratios of the mixed guars. Viscosities were measured after period of 2 hours and 5 days, the results being shown in Table III where the numbers given represent specific Brookfield viscometer readings. The amounts of thickener employed are percent by weight of the slurry liquid phase.

TABLE III

| | | | Hydroxypropyl Guar | | | |
|---|---|---|---|---|---|---|
| | | | 1.2% | 1.0% | 0.8% | 0.6% |
| At 2 hrs. (Process viscosity) | Unmodified guar | Nil | 82 | 56 | 34 | — |
| | | 0.4% | — | 72 | 46 | 32 |
| | | 0.8% | — | 87 | 58 | 39 |

TABLE III-continued

| | | | Hydroxypropyl Guar | | | |
|---|---|---|---|---|---|---|
| | | | 1.2% | 1.0% | 0.8% | 0.6% |
| | | 1.2% | — | >100 | 70 | 50 |
| At 5 days | Un- | Nil | 74 | 67 | 57 | — |
| (Final gel strength) | modi-fied guar | 0.4% | — | 75 | 68 | 50 |
| | | 0.8% | — | 93 | 76 | 58 |
| | | 1.2% | — | >100 | 83 | 68 |

An examination of the results shown in Table III demonstrates that substantially equivalent processing viscosities and substantially equivalent gel strengths can be obtained at various ratios of guar mixtures. This is particularly evident in the diagonally demonstrated results shown in the Gel Strength section. Thus, for example, if a particular cartridging machine has been judged suitable to process a slurry whose thickened liquid phase has a Brookfield viscosity not greater than 60 (that is, to the right of the dotted line in Table III), a blend of 0.8% (by weight of the liquid phase) of hydroxypropyl guar and 0.8% of unmodified guar can be used. Alternatively, a blend of 0.6% hydroxypropyl guar and 1.2% unmodified guar can be employed but some sacrifice in final gel strength results.

EXAMPLE IV

Four, thickened and crosslinked slurry explosive mixtures containing various amounts of the liquid phase Compositions A, B and C were prepared comprising the formulations shown below in Table IV. These mixtures were subjected to viscosity measurements, which results are shown in Table V.

TABLE IV

| | Compositions | | | |
|---|---|---|---|---|
| Ingredients | 1 | 2 | 3 | 4 |
| Ammonium nitrate | 46.04 | 52.84 | 54.23 | 53.64 |
| Ethylene Glycol mononitrate | 13.90 | 14.90 | 14.90 | 13.90 |
| Sodium nitrate | 12.70 | 7.3 | 6.0 | 10.0 |
| Calcium nitrate | 7.9 | 7.9 | 7.9 | 4.0 |
| Water | 9.0 | 9.0 | 9.0 | 9.0 |
| Aluminum metal | 6.0 | 3.0 | 3.0 | 6.0 |

TABLE IV-continued

| | Compositions | | | |
|---|---|---|---|---|
| Ingredients | 1 | 2 | 3 | 4 |
| Ethylene glycol | 1.3 | 1.4 | 1.4 | 1.3 |
| Diethylene glycol | 1.0 | 1.5 | 0.8 | — |
| pH buffers | 0.23 | 0.23 | 0.15 | 0.23 |
| Stabilizers | 0.99 | 0.99 | 0.99 | 0.99 |
| Sulphur | — | — | 0.70 | — |
| Total thickener mixture | 0.9 | 0.9 | 0.9 | 0.9 |
| Crosslinker | 0.04 | 0.04 | 0.04 | 0.04 |
| | 100 | 100 | 100 | 100 |

Composition 1 contains approximately 60% of Composition C in Example 3.
Composition 4 contains approximately 54% of Composition A in Example 1.
Compositions 2 and 3 contain approximately 57% of Composition A in Example 1.

TABLE V

| | COMPOSITIONS | | | | | | | |
|---|---|---|---|---|---|---|---|---|
| | 1 | 1 | 1 | 1 | 2 | 2 | 3 | 4 |
| Composition of Thickener Mixture: | | | | | | | | |
| % by weight Modified Guar | 0.45 | 0.55 | 0.65 | 0.75 | 0.5 | 0.75 | 0.4 | 0.75 |
| % by weight Unmodified Guar | 0.45 | 0.35 | 0.25 | 0.15 | 0.4 | 0.15 | 0.5 | 0.15 |
| 'Apparent' processing Viscosity of fluid phase: | | | | | | | | |
| (RVT, No. 6 Spindle at 5 RPM) 60 min. | 49 | 68 | 82 | 96 | — | — | — | — |
| (Composition C) 120 min. | 58 | 81 | — | — | — | — | — | — |
| 'Apparent' processing Viscosity of slurry explosive mixture: | | | | | | | | |
| (RVT, T-Bar F at 2.5 RPM) 60 min. | 20 | — | — | — | 23 | — | 16 | — |
| Measured Processing Pressure (psig): | | | | | | | | |
| at 60–70 min. | — | 35 | 49 | 68 | 40 | 48 | — | — |
| at 120–150 min. | 58 | 58 | 61 | — | 60 | 52 | 50 | 80 |
| Final Crosslinked Gel Strength of Fluid phase: | | | | | | | | |
| (Helipath, T-Bar at 1 RPM) 5 days | 76 | 79 | 81 | 82 | — | — | — | — |
| Final Crosslinked Gel Strength of slurry explosive mixture: | | | | | | | | |
| (Helipath, T-Bar 0.194 at 1 RPM) 5 days | 23 | 25 | 28 | 32 | 34 | 56 | — | — |

The results given in Table V demonstrate how the practical viscosity measurements on liquid phase of slurry compositions (that is, data shown in Tables I to III) relate to measurements of viscosity and processing pressures of actual final slurry explosive mixtures.

Final slurry explosive mixtures, by virtue of added solid ingredients, are much more viscous than their liquid phases. The measurement of the 'apparent' processing viscosity of the explosive mixture is made using a Brookfield RVT viscometer (T Bar F at 2.5 RPM). The 'apparent' explosive mixture viscosity equivalent to an 'apparent' liquid phase viscosity of 200,000 centipoise is 1,600,000 centipoise. Expressed in terms of a reading from a Brookfield RVT viscometer (using T Bar F at 2.5 RPM) 1,600,000 centipoise is equivalent to a reading of 40.

The final gel strengths of slurry explosive mixtures cannot be measured using commercially available T-bars. A modified T-bar is used. The final gel strength of the slurry explosive mixture equivalent to a liquid phase gel strength of 5,000,000 centipoise is 6,000,000 centipoise. Expressed in terms of a reading from a Brookfield Helipath viscometer (using a modified T-Bar — 0.194 inch — at 1 RPM), 6,000,000 centipoise is equivalent to a reading of 20.

Thus it is the object of the industry to provide a slurry explosive mixture having an 'apparent' viscosity of not more than 28 (Brookfield T Bar F at 2.5 RPM) during mixing and packaging cycle and thereafter to increase in viscosity to achieve a high gel strength and cartridge rigidity equivalent to 'apparent' viscosities giving readings in excess of 20 (modified T-Bar 0.194 inch).

As is shown in Table V, this objective is met by using mixtures of modified and unmodified guars as the thickening component in the slurry explosive mixture. It is also shown that by adjusting the amount of each thickener component in the mixture, substantially lower and safer processing pressures can be attained during the packaging cycle without substantially affecting the final gel strength of the slurry explosive mixture.

What we claim is:

1. In a slurry explosive composition containing water, inorganic oxidizer salt, fuel, thickener, thickener cross-linker and, as a sensitizer, a soluble organic nitrate, the improvement comprising a thickener consisting essentially of a combination of unmodified guar gum and hydroxypropyl-modified guar gum, which thickener provides slurry composition viscosities suitable for extrusion packaging and which develops post-packaging viscosities resulting in firm, shape-retaining, tampable cartridges.

2. An explosive composition as claimed in claim 1 wherein the thickener comprises from 0.2% to 2.0% by weight of the total composition in the ratio of from 15 to 85 parts by weight of unmodified guar to 85 to 15 parts by weight of hydroxypropyl-modified guar.

3. An explosive composition as claimed in claim 2 wherein the thickener comprises from 0.4% to 1.6% by weight of the total composition.

4. A thickened and cross-linked water-bearing explosive slurry composition comprising up to 75% by weight of inorganic oxygen-supplying salt, up to 25% by weight of water, from 10% to 31% by weight of soluble organic nitrate sensitizer, up to 40% by weight of fuel, from 0.2% to 2.0% by weight of a thickener comprising a mixture of from 15 to 85 parts by weight of unmodified guar gum to 85 to 15 parts by weight of hydroxypropyl-modified guar gum and up to 1.0% by weight of thickener cross-linker.

5. An explosive composition as claimed in claim 4 wherein up to 27% of the total amount of inorganic oxygen-supplying salt comprises calcium nitrate.

6. An explosive composition as claimed in claim 4 wherein the soluble organic nitrate sensitizer is selected from the groups consisting of hydroxyalkyl nitrate, alkanolamine nitrate and alkylamine nitrate.

* * * * *